US012673806B1

(12) United States Patent
Peng et al.

(10) Patent No.: US 12,673,806 B1
(45) Date of Patent: Jul. 7, 2026

(54) DUAL-DRINKING LID FOR CONTAINER

(71) Applicant: Zhejiang Coolests Technology Co., Ltd., Jinhua City (CN)

(72) Inventors: Liquan Peng, Jinhua City (CN); Weizhen Hu, Jinhua City (CN); Changgen Ying, Jinhua City (CN)

(73) Assignee: Zhejiang Coolests Technology Co., Ltd., Jinhua City (CN)

( * ) Notice: Subject to any disclaimer, the term of this patent is extended or adjusted under 35 U.S.C. 154(b) by 0 days.

(21) Appl. No.: 19/390,416

(22) Filed: Nov. 14, 2025

(30) Foreign Application Priority Data

Oct. 9, 2025 (CN) ..... 202511445216.3
Oct. 9, 2025 (CN) ..... 202522133888.2

(51) Int. Cl.
*B65D 47/08* (2006.01)

(52) U.S. Cl.
CPC ..... *B65D 47/088* (2013.01)

(58) Field of Classification Search
CPC ..... B65D 47/283; B65D 47/247; B65D 2543/00046; B65D 47/088; A47G 21/18; A47G 21/185; A47G 19/2272; A47G 19/2266
See application file for complete search history.

(56) References Cited

U.S. PATENT DOCUMENTS

2016/0200486 A1* 7/2016 Meyers ..... A47G 19/2288 215/229
2016/0325892 A1* 11/2016 Yamaguchi ..... B65D 47/0857
2018/0050844 A1* 2/2018 Hirst ..... B65D 47/24
2020/0281381 A1 9/2020 Sorensen et al.

FOREIGN PATENT DOCUMENTS

CN 214341531 U 10/2021

* cited by examiner

*Primary Examiner* — Jeffrey R Allen
(74) *Attorney, Agent, or Firm* — Mei & Mark LLP; Manni Li

(57) ABSTRACT

A dual-drinking lid for a container comprises a lid body and a sipping spout, where an upper surface of the lid body is provided with a recessed portion, and a through hole is formed in a bottom of the recessed portion; a liquid guiding port is formed in a portion of the sipping spout located in the recessed portion, and the liquid guiding port is communicated with the through hole through the recessed portion to form a second liquid passage; a switching member configured to block or communicate the second liquid passage is disposed in the recessed portion; and the switching member is configured to switch between a direct-drinking mode and a straw-drinking mode. The present invention solves the problems of a dual-drinking lid in the prior art, such as cumbersome switching between the direct-drinking mode and the straw-drinking mode, and cumbersome assembly due to a complex structure.

7 Claims, 6 Drawing Sheets

DUAL-DRINKING LID FOR CONTAINER

CROSS-REFERENCE TO RELATED APPLICATIONS

The subject application claims priority on Chinese Patent Application Nos. CN202511445216.3 and CN202522133888.2, both filed on Oct. 9, 2025 in China. The contents and subject matters of the Chinese priority applications are incorporated herein by reference.

TECHNICAL FIELD

The present invention relates to the technical field of liquid containers, and in particular to a dual-drinking lid for a container.

BACKGROUND ART

Switching between dual drinking modes has been a persistent challenge in the design of a lid for a drinking container. To provide the drinking container with the dual drinking modes, a variety of lids have been developed.

Chinese Patent Publication No. CN105916411B discloses a lid for a container. A lid body is provided with a spout, a first opening disposed in the spout, a second opening disposed in the spout, a straw connecting portion, and a straw, where the first opening provides a first fluid path to a fluid disposed in a liquid storage portion of an attached container; the second opening provides a second fluid path to the fluid disposed in the liquid storage portion of the attached container, and the second opening has a rectangular shape; the straw connecting portion is in fluid communication with the second opening, and the straw connecting portion has a circular cross section; and the straw has an end configured to be received in the straw connecting portion so as to extend the second fluid path into the liquid storage portion of the attached container, and the straw has a circular cross section. The lid body further comprises a common wall separating the first opening and the second opening.

Although the solution provides dual drinking modes, the two modes coexist ambiguously without a switching function. During use in the straw-drinking mode, liquid may flow out from a direct-drinking opening when a tilt angle becomes excessive. The technical solution is merely a makeshift measure.

Chinese Patent Publication No. CN214341531U discloses a container lid, a water outlet control rotating member for the container lid, and a drinking container. The container lid comprises a water outlet control rotating member and a water outlet valve; a lid body is provided with a container interior communication port and a straw communication port; the water outlet valve is fixedly disposed in a middle of the lid body, an inner cavity of the water outlet valve is provided with a pour-drinking mode water outlet hole communicating with the container interior communication port, and a straw-drinking mode water outlet hole communicating with the straw communication port; and the water outlet control rotating member is rotatably arranged on the lid body and is provided with a pipe having a sipping spout, and the pipe has a through hole and is inserted into the inner cavity of the water outlet valve. Rotation of the water outlet control rotating member may form a pour-drinking mode in which the through hole, the pour-drinking mode water outlet hole, and the container interior communication port are communicated with each other.

The technical solution truly achieves switching between the direct-drinking mode and the straw-drinking mode through switching of the water outlet holes of the water outlet valve, rather than an ambiguous coexistence of the two modes. However, the water outlet valve is complex in structure and requires cooperation with the water outlet control rotating member. The lid involves numerous components, complicated fabrication, cumbersome assembly, excessively low production efficiency, and high costs. Therefore, the solution is not ideal.

SUMMARY OF THE INVENTION

An objective of the present invention is to provide a dual-drinking lid for a container to mainly solve the problems of a dual-drinking lid in the existing technology, such as cumbersome switching between a direct-drinking mode and a straw-drinking mode, and cumbersome assembly due to a complex structure.

To achieve the above objective, the technical solution of the present invention is as follows:

A dual-drinking lid for a container comprises a lid body and a sipping spout disposed on the lid body, wherein the sipping spout is internally provided with a first liquid passage penetrating through the lid body from an upper surface to a lower surface; and the upper surface of the lid body is provided with a recessed portion facing the lower surface, and a through hole is formed in a bottom of the recessed portion; a liquid guiding port is formed in a portion of the sipping spout located in the recessed portion, and the liquid guiding port is communicated with the through hole through the recessed portion to form a second liquid passage; a switching member configured to block or communicate the second liquid passage is disposed in the recessed portion; when the switching member blocks the liquid guiding port, the second liquid passage is blocked; and when the switching member does not block or does not completely block the liquid guiding port, the second liquid passage is communicated.

The switching member comprises an operation portion and a blocking portion connected to each other, where the operation portion has a penetrating sleeve hole, the switching member is sleeved onto the sipping spout through the sleeve hole, and the blocking portion is disposed in the recessed portion; and when the operation portion is moved upward or downward on the sipping spout, the blocking portion is moved to unblock or block the liquid guiding port, so as to communicate or block the second liquid passage.

The switching member is in a stepped shape, and an upper portion of the blocking portion is disposed at a bottom edge of the operation portion.

The switching member is made of a silicone material.

A limiting cover plate is disposed at an opening portion of the recessed portion, a through hole is formed in the limiting cover plate, and the limiting cover plate is sleeved onto the sipping spout via the through hole to cover the opening portion of the recessed portion.

The limiting cover plate is provided with a snap-in portion, and the snap-in portion is in snap-in connection to the lid body.

An upper cover is disposed, the upper cover is pivotally connected to the lid body, and the upper cover is configured to cover the sipping spout when closed over the lid body.

A straw insertion portion is disposed at an opening of the first liquid passage in the lower surface of the lid body.

The lid body and the sipping spout are integrally formed.

The advantages of the present invention are as follows: 1. The recessed portion with the through hole at a bottom is creatively formed in the lid body, and the liquid guiding port is formed in the lower portion of the sipping spout, such that the second liquid passage is established in the lid body; 2. the switching member enables rapid and convenient switching between a direct-drinking mode and a straw-drinking mode; 3. the operation portion of the switching member is sleeved onto the sipping spout, which not only ensures the positional stability of the switching member but also guarantees operational stability while simultaneously achieving convenient switching; 4. the limiting cover plate is in snap-in connection to the lid body, which ensures that the switching member does not detach from the recessed portion and also ensures that the switching is achieved within a short distance; and 5. the design of the switching member significantly reduces the number of components of the product, greatly lowers the cost, facilitates installation, and substantially improves production efficiency.

Figure 1:
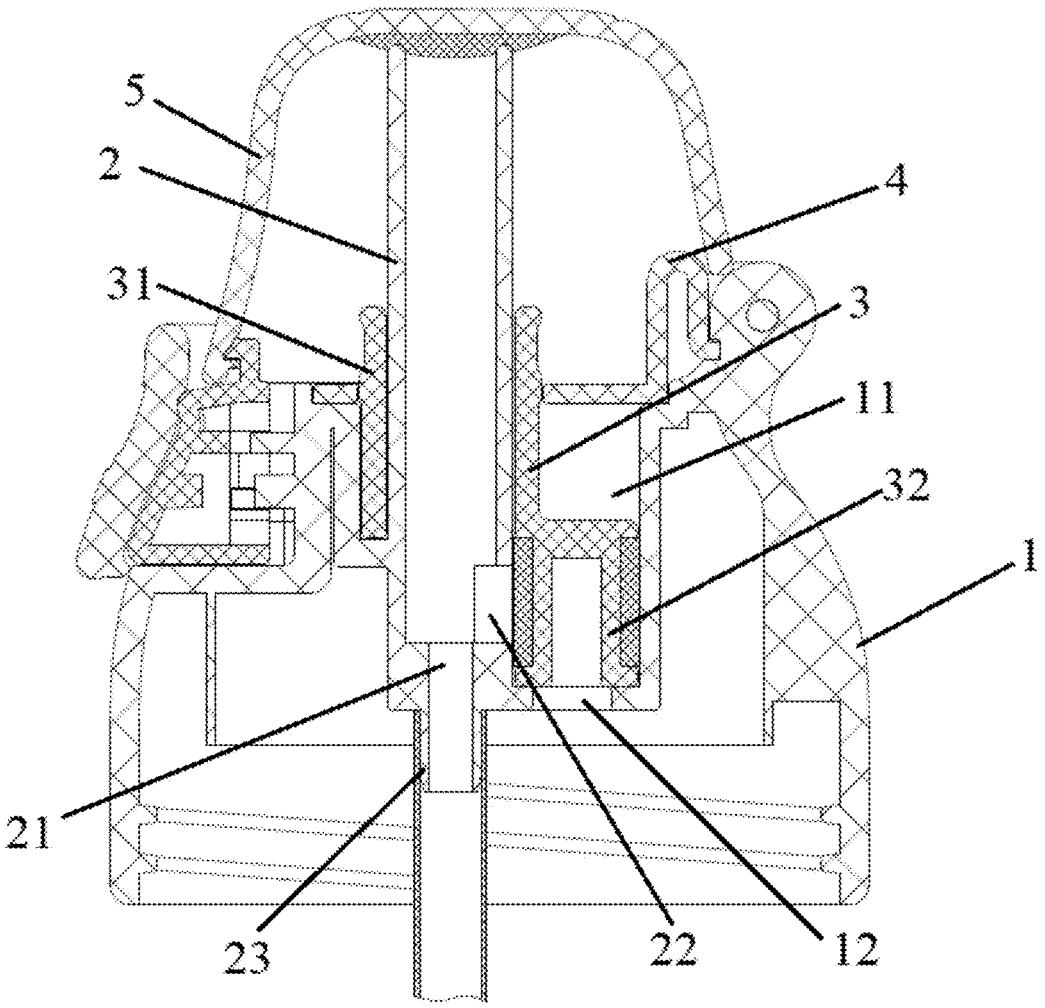
FIG. 1 is a sectional structural view of a dual-drinking lid of the present invention when a second liquid passage is blocked.

Reference numerals in the figures refer to the following structures: 1—lid body; 11—recessed portion; 12—through hole; 2—sipping spout; 21—first liquid passage; 22—liquid guiding port; 3—switching member; 31—operation portion; 32—blocking portion; 33—sleeve hole; 4—limiting cover plate; 41—through hole; 42—snap-in portion; and 5—upper cover.

DETAILED DESCRIPTION OF THE INVENTION

The present invention will be further described below in detail in combination with the drawings. The drawings are intended for illustrative purposes only and should not be construed as limiting the scope of the present invention.

To more concisely describe this embodiment, some components well known to those skilled in the art, but not directly related to the main contents of the present invention, may be omitted from the drawings or specification. Additionally, for ease of expression, certain components in the drawings may be omitted, enlarged, or reduced in size, and do not represent actual dimensions or a complete structure of a product.

The present invention discloses a dual-drinking lid for a container. As shown in FIGS. 1 to 7, the lid comprises a lid body 1 and a sipping spout 2, where the sipping spout 2 is disposed on an upper surface of the lid body 1 and protrudes from the upper surface of the lid body 1. Preferably, the lid body 1 and the sipping spout 2 are integrally formed.

As shown in FIGS. 1 to 4, the sipping spout 2 is internally provided with a first liquid passage 21 penetrating through the lid body 1 from the upper surface to a lower surface. Further, a straw insertion portion 23 is disposed at an opening of the first liquid passage 21 in the lower surface of the lid body 1. When the lid body 1 is closed on an opening portion of the container, liquid in the container may be sipped out from the sipping spout 2 through a straw and the first liquid passage 21. The first liquid passage 21 corresponds to a straw-drinking mode of the dual-drinking lid.

Figure 2:
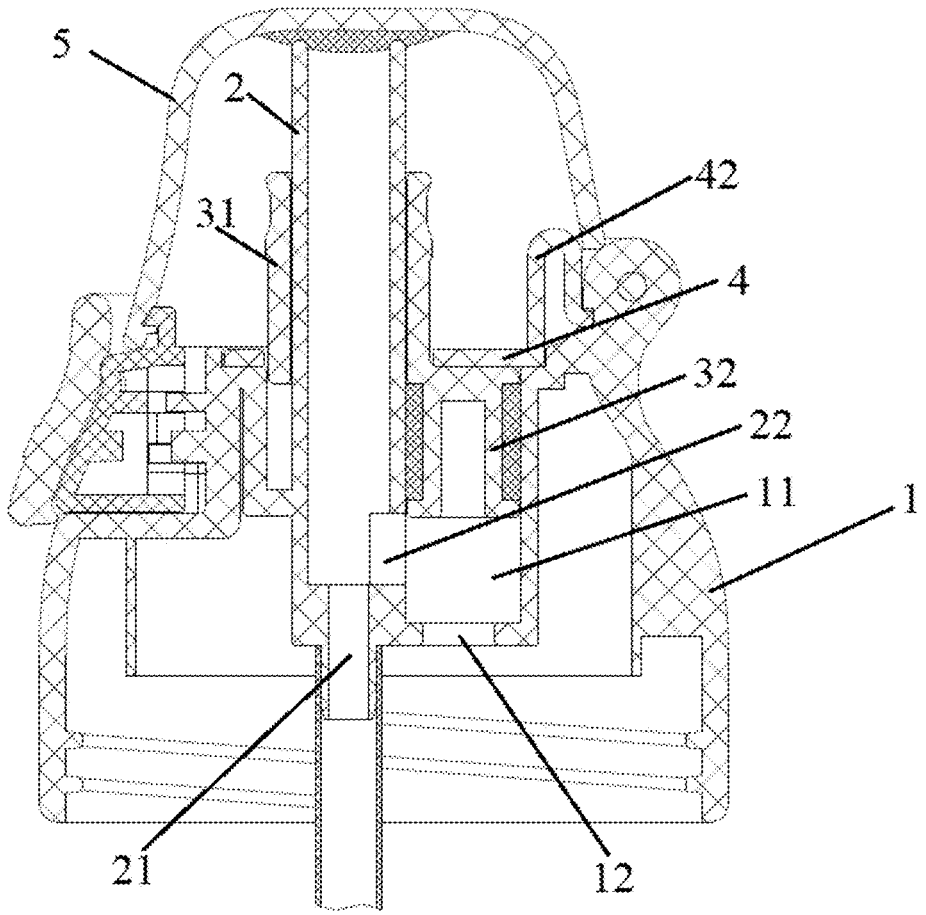
FIG. 2 is a sectional structural view of a dual-drinking lid of the present invention when a second liquid passage is communicated.
Figure 3:
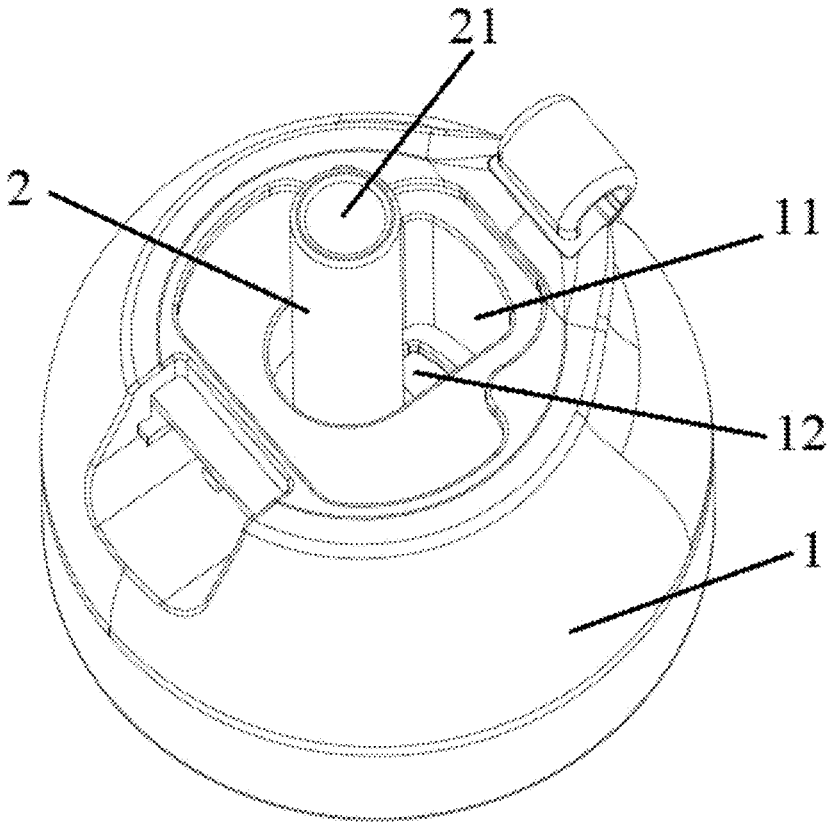
FIG. 3 is a schematic structural view of a lid body of the present invention.

As shown in FIGS. 1 to 3, the upper surface of the lid body 1 is provided with a recessed portion 11 facing the lower surface, a lower portion of the sipping spout 2 is located in the recessed portion 11, a through hole 12 is formed in a bottom of the recessed portion 11, and the through hole 12 penetrates through the upper surface and the lower surface of the lid body 1.

Figure 4:
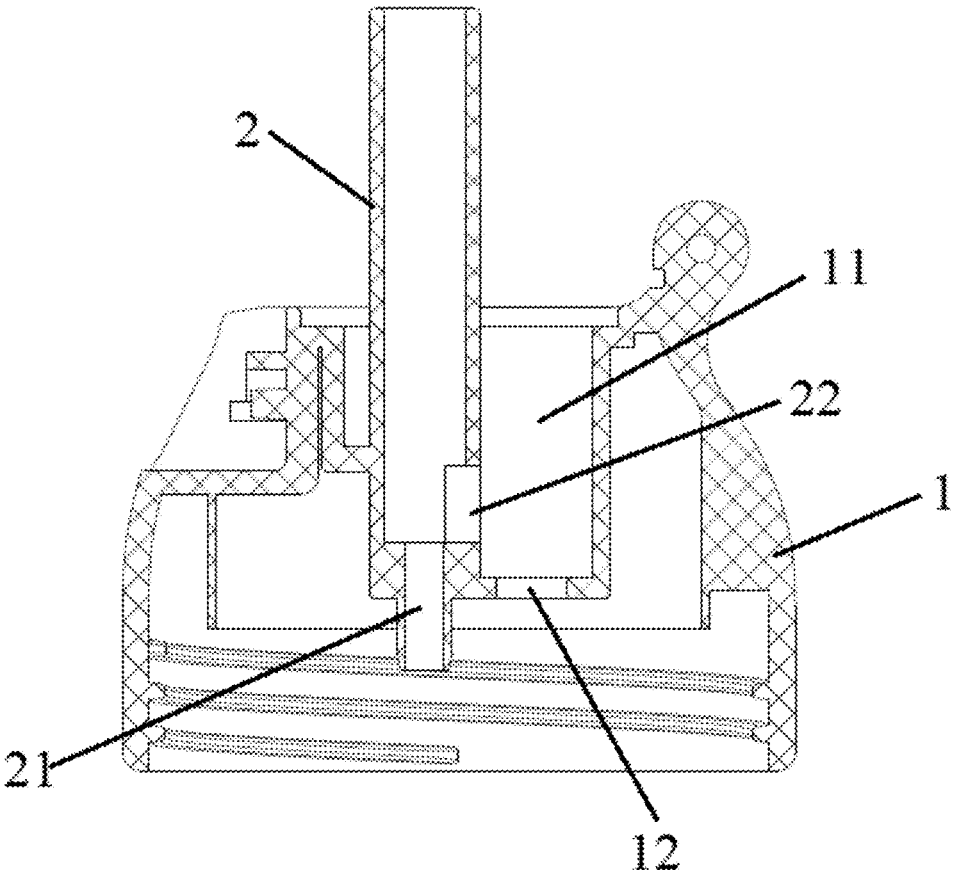
FIG. 4 is a sectional structural view of a lid body of the present invention.

As shown in FIG. 4, a liquid guiding port 22 is formed in a portion of the sipping spout 2 located in the recessed portion 11, and the liquid guiding port 22 is communicated with the through hole 12 through the recessed portion 11 to form a second liquid passage; and the second liquid passage enables liquid to enter the sipping spout 2 sequentially through the through hole 12, the recessed portion 11, and the liquid guiding port 22. The second liquid passage corresponds to a direct-drinking mode of the dual-drinking lid.

To switch between the straw-drinking mode and the direct-drinking mode, as shown in FIGS. 1 and 2, a switching member 3 configured to block or communicate the second liquid passage is disposed in the recessed portion 11. As shown in FIG. 2, when the switching member 3 does not block or does not completely block the liquid guiding port 22, the second liquid passage is communicated, and the direct-drinking mode is achieved. As shown in FIG. 1, when the switching member 3 blocks the liquid guiding port 22, the second liquid passage is blocked, and liquid may only be sipped out from the sipping spout 2 through the first liquid passage 21 in the straw-drinking mode.

Figure 5:
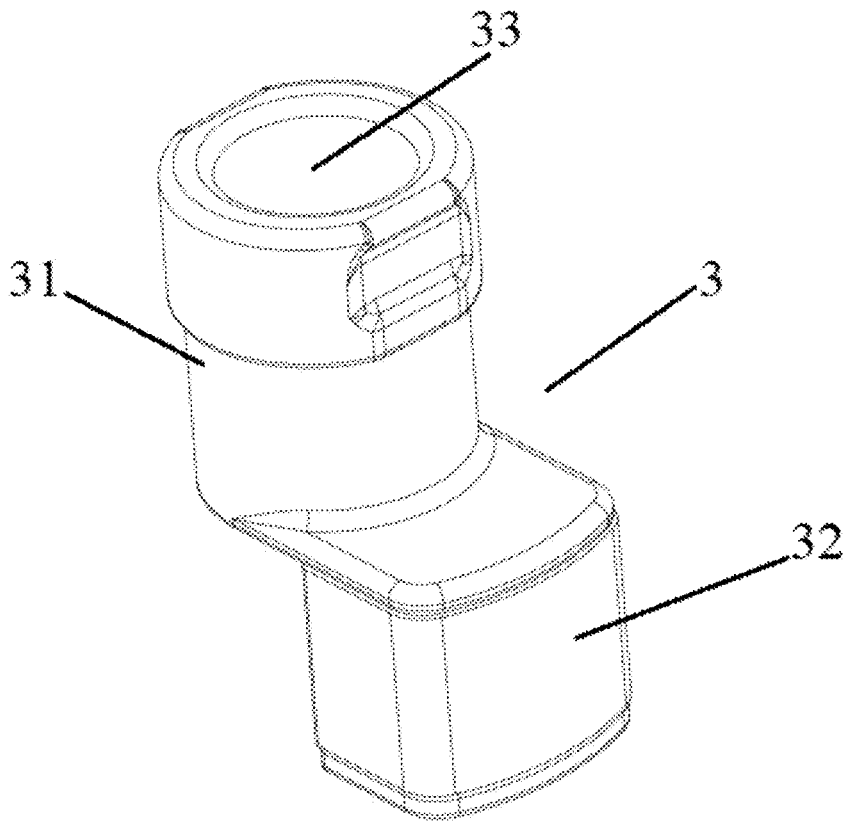
FIG. 5 is a schematic structural view of a switching member of the present invention.

Preferably, as shown in FIG. 5, the switching member 3 comprises an operation portion 31 and a blocking portion 32 connected to each other, where the operation portion 31 has a penetrating sleeve hole 33, the switching member 3 is in a stepped shape, and an upper portion of the blocking portion 32 is disposed at a bottom edge of the operation portion 31. The switching member 3 is sleeved onto the sipping spout 2 through a sleeve hole 33, and the blocking portion 32 is disposed in the recessed portion 11. As shown in FIG. 2, when the operation portion 31 is moved upward on the sipping spout 2, the operation portion 31 drives the blocking portion 32 to move upward in the recessed portion 11. When the blocking portion 32 rises to a position where the liquid guiding port 22 is exposed, i.e., the blocking portion 32 does not block or does not completely block the liquid guiding port 22, a fluid communication is formed between the liquid guiding port 22 and the through hole 12. Consequently, the second liquid passage is established, such that liquid may be poured out from the sipping spout 2 in the direct-drinking mode.

When it is necessary to switch to the straw-drinking mode, as shown in FIG. 1, the operation portion 31 is moved downward on the sipping spout 2, and thus the blocking portion 32 is driven to move downward in the recessed portion 11. When the blocking portion 32 completely blocks the liquid guiding port 22, the second liquid passage is blocked, and liquid may only be sipped out from the sipping spout 2 through the first liquid passage 21 and cannot be poured out from the sipping spout 2 through the second liquid passage.

Preferably, the switching member 3 is made of a silicone material, which facilitates both installation and replacement.

Figure 6:
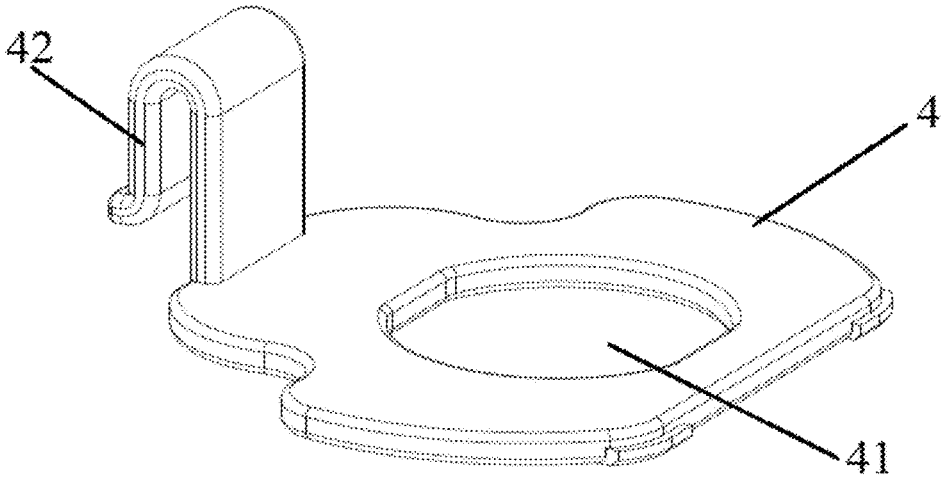
FIG. 6 is a schematic structural view of a limiting cover plate of the present invention.
Figure 7:
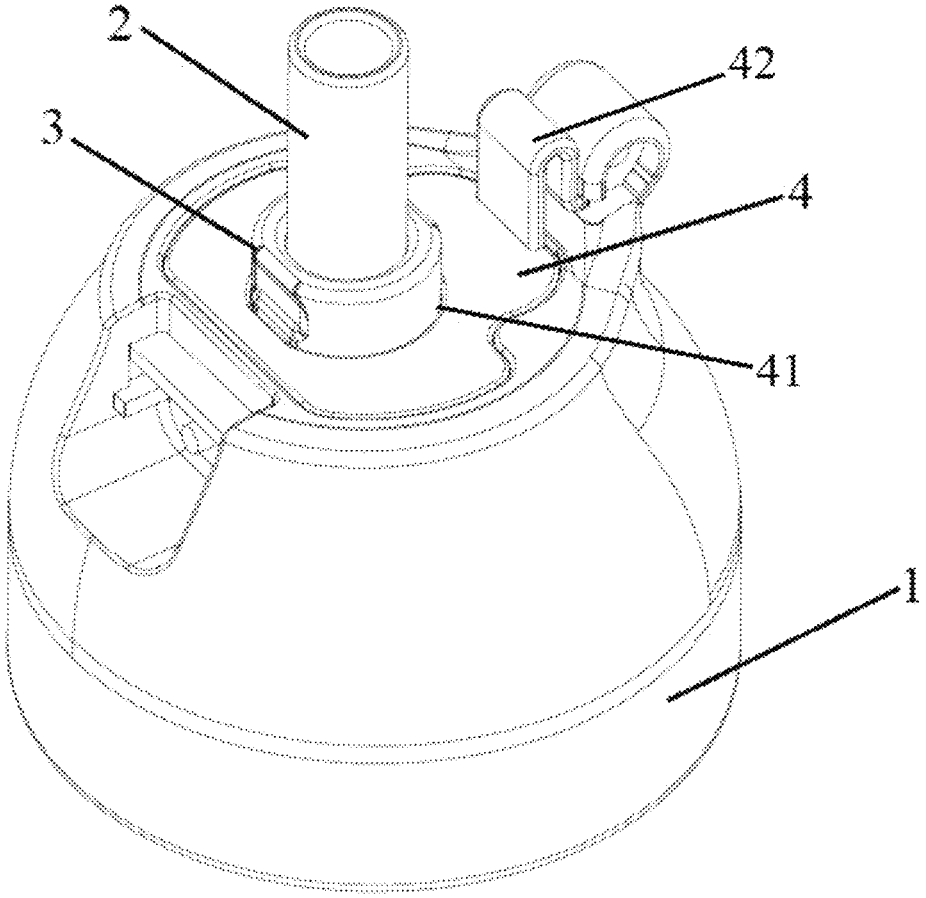
FIG. 7 is a schematic structural view of a dual-drinking lid of the present invention.

To prevent the switching member 3 from detaching from the sipping spout 2 during switching, a limiting cover plate 4 is disposed at an opening portion of the recessed portion 11. As shown in FIGS. 6 and 7, a through hole 41 is formed in the limiting cover plate 4, and the limiting cover plate 4 is sleeved onto the sipping spout 2 through the through hole 41 to cover the opening portion of the recessed portion 11. The limiting cover plate 4 is provided with a snap-in portion 42, and the snap-in portion 42 is in snap-in connection to the lid body 1. The operation portion 31 of the switching member 3 also penetrates through the through hole 41, and the switching member 3 slides on the sipping spout 2 through the through hole 41.

As shown in FIGS. 1 and 2, for hygiene and carrying safety, an upper cover 5 is further disposed, and the upper cover 5 is pivotally connected to the lid body 1. The upper cover 5 covers the sipping spout 2 when closed over the lid body 1, thereby preventing liquid in the container from flowing out.

The above descriptions are merely preferred embodiments of the present invention and are not intended to define the implementation scope of the present invention. All equivalent changes and modifications made according to the contents of the patent claims of the present invention should fall within the technical scope of the present invention.

We claim:

1. A dual-drinking lid for a container, comprising:

a lid body, wherein the lid body comprises an upper surface and a lower surface, a sipping spout disposed on the lid body, wherein the sipping spout is internally provided with a first liquid passage penetrating through the lid body from the upper surface of the lid body to the lower surface of the lid body, a recess portion, wherein the recess portion is provided on the upper surface of the lid body facing the lower surface of the lid body, a through hole is formed in a bottom of the recessed portion, and a lower portion of the sipping spout is located in the recessed portion, a liquid guiding port, wherein the liquid guiding port is formed in the lower portion of the sipping spout located in the recessed portion, and the liquid guiding port is in liquid communication with the through hole in the bottom of the recessed portion to form a second liquid passage, and a switching member disposed in the recessed portion, wherein the switching member comprises an operation portion and a blocking portion connected to each other in a stepped shape with an upper portion of the blocking portion being disposed at a bottom edge of the operation portion, the operation portion comprises a penetrating sleeve hole, the switching member is sleeved onto the sipping spout through the penetrating sleeve hole, and the blocking portion is disposed in the recessed portion, and when the operation portion is moved upward or downward on the sipping spout, the blocking portion is driven to open or block the liquid guiding port so as to open or block the second liquid passage.

2. The dual-drinking lid for a container according to claim 1, wherein the switching member is made of a silicone material.

3. The dual-drinking lid for a container according to claim 1, further comprising:

a limiting cover plate disposed at an opening portion of the recessed portion, wherein the limiting cover plate is provided with a through hole, and the limiting cover plate is sleeved onto the sipping spout through the through hole to cover the opening portion of the recessed portion.

4. The dual-drinking lid for a container according to claim 3, wherein the limiting cover plate is provided with a snap-in portion, and the snap-in portion is in snap-in connection to the lid body.

5. The dual-drinking lid for a container according to claim 1, further comprising:

an upper cover, wherein the upper cover is pivotally connected to the lid body and configured to cover the sipping spout when the upper cover is in a closed position over the lid body.

6. The dual-drinking lid for a container according to claim 1, wherein a straw insertion portion is disposed at an opening of the first liquid passage in the lower surface of the lid body.

7. The dual-drinking lid for a container according to claim 1, wherein the lid body and the sipping spout are integrally formed.

* * * * *